US007699038B2

(12) United States Patent
Laurens et al.

(10) Patent No.: US 7,699,038 B2
(45) Date of Patent: Apr. 20, 2010

(54) METHOD FOR CONTROLLING THE OPENING OF A THROTTLE VALVE BODY ASSEMBLY

(75) Inventors: Christophe Laurens, Paris (FR); Francois Ratinet, Limours (FR); Frederic Thevenod, Levallois (FR)

(73) Assignee: Renault Sport Technologies, Les Ulis (FR)

( * ) Notice: Subject to any disclaimer, the term of this patent is extended or adjusted under 35 U.S.C. 154(b) by 17 days.

(21) Appl. No.: 11/994,503

(22) PCT Filed: Jun. 14, 2006

(86) PCT No.: PCT/FR2006/050557

§ 371 (c)(1),
(2), (4) Date: Jul. 24, 2008

(87) PCT Pub. No.: WO2007/003833

PCT Pub. Date: Jan. 11, 2007

(65) Prior Publication Data

US 2008/0289601 A1 Nov. 27, 2008

(30) Foreign Application Priority Data

Jul. 4, 2005 (FR) ..... 05 52024

(51) Int. Cl.
*F02D 11/10* (2006.01)

(52) U.S. Cl. ..... 123/399; 123/403

(58) Field of Classification Search ..... 123/349, 123/395, 402, 403, 396, 399; 701/110, 115
See application file for complete search history.

(56) References Cited

U.S. PATENT DOCUMENTS

| | | | | |
|---|---|---|---|---|
| 4,519,361 | A * | 5/1985 | Murakami | 123/399 |
| 5,150,680 | A * | 9/1992 | Nishimura | 123/399 |
| 6,276,333 | B1 * | 8/2001 | Kazama et al. | 123/399 |
| 7,191,757 | B2 * | 3/2007 | Takeuchi et al. | 123/396 |
| 7,357,103 | B2 * | 4/2008 | Koopmans | 123/27 R |
| 2003/0213466 | A1 | 11/2003 | Rayl | |
| 2004/0147363 | A1 | 7/2004 | Auguet et al. | |
| 2005/0056251 | A1 | 3/2005 | Stroh et al. | |
| 2006/0042592 | A1 * | 3/2006 | Confer et al. | 123/399 |

FOREIGN PATENT DOCUMENTS

| | | |
|---|---|---|
| DE | 102 54 595 | 6/2004 |
| DE | 102 57 061 | 6/2004 |

OTHER PUBLICATIONS

English Translation of DE 102 54 595 (Hagerodt; Mar. 6, 2004).*

* cited by examiner

*Primary Examiner*—Stephen K Cronin
*Assistant Examiner*—Anthony L Bacon
(74) *Attorney, Agent, or Firm*—Oblon, Spivak, McClelland, Maier & Neustadt, L.L.P.

(57) ABSTRACT

The invention concerns a method for controlling the opening of an internal combustion engine throttle valve body assembly, characterized in that it includes the following steps: specifically mapping the engine, limiting the opening angle of the throttle valve body assembly, and defining particular operating points requiring replacement of the usual mapping by the specific mapping.

11 Claims, 1 Drawing Sheet

METHOD FOR CONTROLLING THE OPENING OF A THROTTLE VALVE BODY ASSEMBLY

BACKGROUND OF THE INVENTION

I. Field of the invention

The present invention relates to the field of engine control. More specifically, it relates to a strategy for opening the intake throttle of an internal combustion engine.

This invention finds a favored, although non-exclusive, application in normally-aspirated spark-ignition gasoline engines, but turbocharged diesel engines can also benefit from the proposed strategy.

II. Description of Related Art

Under full load acceleration, the throttle pedal is fully depressed. The computer sends the "wide open throttle" information to the motorized throttle valve body assembly, and the throttle valve is opened wide throughout the speed range. The cross section opened up by opening the throttle wide is designed not to restrict the air supply to the engine when the air supply is entering at its maximum flowrate. The size of the opening is therefore calculated to meet maximum flowrate requirements, that is to say to provide maximum power. Thus, the opening in the throttle valve body assembly is often too great, and the throttle valve body assembly is therefore oversized.

Opening the throttle wider than just the amount needed has no positive effect on engine behavior or performance but detracts from the pleasure of driving the vehicle by needlessly increasing the level of engine noise. Indeed, it has been found that some engine noise, identified as "induction noise" is directly associated with the opening of the throttle.

Publication JP 200129571 discloses a reduction in engine noise by modifying the passage cross section for air through the induction circuit. The system described does actually make it possible to limit the noise level under certain circumstances but takes no account of the true engine operating conditions.

BRIEF SUMMARY OF THE INVENTION

The present invention is aimed at limiting the throttle opening to the opening just needed to satisfy the engine's need for air, in order to achieve full load in spite of this restriction.

To this end, the invention proposes to establish a dedicated engine map for limiting the throttle opening angle and to define specific operating points that require this map to be substituted for the usual map.

This substitution results in a temporary limit on the throttle opening angle.

The result of this is a marked reduction in induction noise under full load acceleration, this reduction increasing the further the power delivered by the engine is away from the maximum power of the engine.

BRIEF DESCRIPTION OF THE DRAWINGS

Further features and advantages of the present invention will be better understood from reading the following description of a nonlimiting embodiment thereof, with reference to the attached drawings in which the single FIGURE summarizes the proposed strategy.

DETAILED DESCRIPTION OF THE INVENTION

Figure 1:
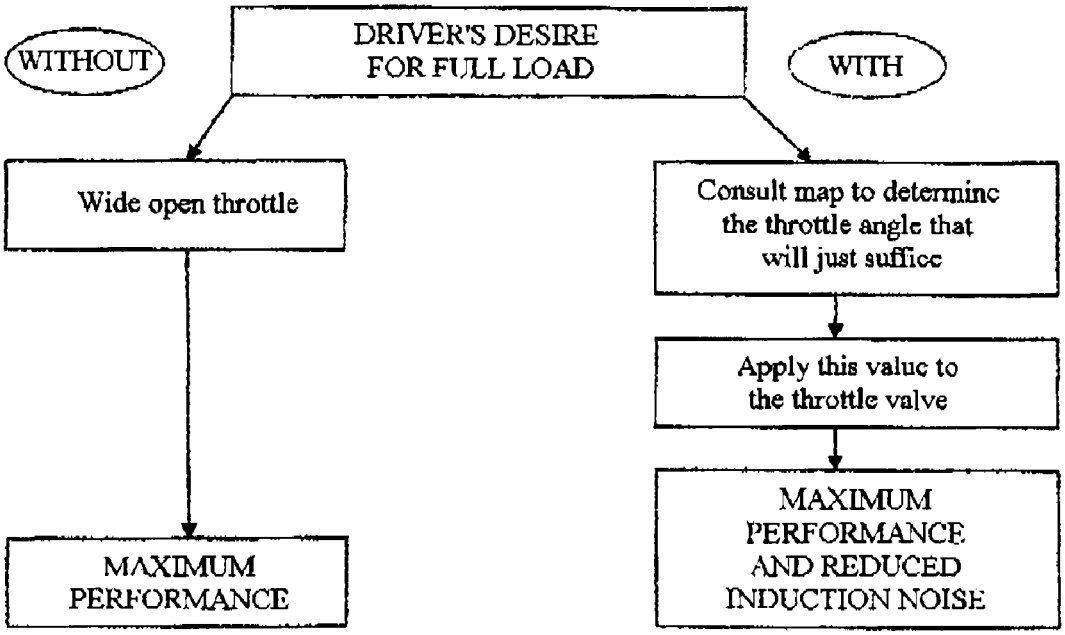

No structural modification to the throttle valve body assembly, to the engine, or to the computer is envisioned in any of the applications adopted. The preferred embodiment of the invention as described hereinbelow is therefore nonlimiting. It makes it possible, for example, to reduce the full load induction noise of a normally-aspirated gasoline engine with the aim of reducing the overall vehicle noise by 1 to 2 dB in order to meet acoustic regulations.

Modifying the engine control strategies makes it possible to apply a calculated limit on the throttle opening angle so that the manifold pressure drops by a maximum of 5 mbar; an engine requirement map is established in this way. This map can be temporarily substituted for the usual strategy, according to the circumstances.

As indicated in the diagram, the condition required for substitution to take place is for the driver to be demanding full load through his use of the throttle pedal. In a development step, it will be beneficial to have defined operating points at which the throttle opening needs to be limited, and for the calculated values to have been programmed accordingly.

At these operating points, the engine computer consults the substitute map to determine the throttle opening angle strictly needed to obtain maximum engine performance, that is to say to avoid any loss in performance with respect to the wide open throttle datum. Thus, the limit is calculated in such a way as always to achieve full engine load, when this is demanded by the driver, in spite of the maps having been swapped.

Application of the substitute map therefore leads to a limit on the throttle opening angle, which limit has no impact on engine performance. The limit on the throttle opening angle is calculated to drop the manifold pressure by a predefined value.

Outside of the substitute points, the usual throttle opening control strategy is maintained, and the driver's demand for full load results in a wide open throttle situation allowing maximum engine performance to be obtained.

According to another feature of the invention, the limit on the throttle opening angle increases the further the engine is away from the maximum power situation.

In practice, the acoustic savings afforded by these measures depend in part on the "acoustic transparency" of the intake of the engine concerned, that is to say on the way in which noise caused on the intake side is deadened by the engine. However, it will always be the case that the more noisy the engine is in terms of "induction noise", the greater will be the impact of the measures proposed.

By way of example, it is possible with certain engines to obtain a noise reduction of between 0.5 dB and 2 dB, for example in second gear revving between 3000 rpm and 4800 rpm, in third gear revving between 2000 rpm and 3200 rpm, with significant restrictions on opening, and with no impact on performance.

The measures proposed by the invention are not, however, exclusive of other constructional arrangements that can be adopted to improve the internal acoustic qualities of the engine. Indeed it is known that these acoustic qualities can be improved, without degrading vehicle performance, for example by concentrating the noise level of the engine under certain conditions or, on the other hand, reducing it in other circumstances.

All vehicles fitted with a normally-aspirated spark-ignition engine can benefit from the invention, the application of which requires nothing more than some changes to the strategies already embedded in the computer, and appropriate calibration, without any modification to the structure of the computer or that of the engine or that of the vehicle.

In a diesel engine, the lack of a throttle valve body assembly for regulating the power means that the invention cannot be applied directly. However, fitting a throttle valve body assembly and using it as a control valve is still conceivable. This will then make it possible to apply the control method proposed by the invention under conditions analogous to those of a spark-ignition engine.

Finally, applying the invention to a turbocharged engine is not excluded, although this last application assumes that the additional steps of filtering out the noise caused by the turbocharger and the intercooler can be incorporated into the strategy and into the calibration steps.

The invention claimed is:

1. A method of controlling a throttle opening in an internal combustion engine, comprising:

establishing a dedicated engine map for limiting a throttle opening angle, wherein the throttle opening angle is a minimum angle required to satisfy an air need for the engine to achieve maximum performance;

defining specific operating points that require the dedicated map to be substituted for a usual map such that the engine can achieve maximum performance while the throttle opening angle is less than a maximum throttle opening angle; and substituting the dedicated map for the usual map as long as the engine is operating within the specific operating points.

2. The control method as claimed in claim 1, wherein the substituting is temporary.

3. The control method as claimed in claim 1, wherein the limit on the throttle opening angle is calculated to drop a manifold pressure by a predefined value.

4. The control method as claimed in claim 3, wherein the predefined value of the drop of the manifold pressure is 5 mbar.

5. The control method as claimed in claim 1, wherein the limit on the throttle opening angle has no effect on engine performance.

6. The control method as claimed in claim 5, wherein the limit is calculated such that the engine can achieve full load when the full load is demanded by the driver.

7. The control method as claimed in claim 1, wherein the limit on the throttle opening angle is greater the further the engine is away from maximum power.

8. The control method as claimed in claim 1, further comprising:

utilizing the usual map when the engine operates outside of the specific operating points.

9. The control method as claimed in claim 1, wherein the engine is a normally-aspirated spark-ignition engine.

10. The control method as claimed in claim 1, wherein the engine is a diesel engine.

11. The control method as claimed in claim 1, wherein the engine is a turbocharged engine.

* * * * *